US007541552B2

(12) United States Patent
Su

(10) Patent No.: US 7,541,552 B2
(45) Date of Patent: Jun. 2, 2009

(54) SWITCH PIN FOR SMD MANUFACTURING PROCESSES

(75) Inventor: Tsui-Jung Su, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 7 days.

(21) Appl. No.: 11/272,692

(22) Filed: Nov. 15, 2005

(65) Prior Publication Data

US 2007/0108031 A1 May 17, 2007

(51) Int. Cl.
*H01R 13/46* (2006.01)

(52) U.S. Cl. ..... 200/294; 439/884

(58) Field of Classification Search ..... 200/448, 200/292, 293–296; 439/188, 884
See application file for complete search history.

(56) References Cited

U.S. PATENT DOCUMENTS 4,283,609 A * 8/1981 Schadow ..... 200/460
4,948,376 A * 8/1990 Penning ..... 200/51.1
6,030,240 A * 2/2000 Duff ..... 200/51.1
6,099,334 A * 8/2000 Togashi ..... 200/51.1
6,280,214 B1 * 8/2001 Chang ..... 200/51.1
6,399,908 B1 * 6/2002 Mueller et al. ..... 200/249
6,520,785 B2 * 2/2003 Hida ..... 200/51.09

* cited by examiner

*Primary Examiner*—Elvin G Enad
*Assistant Examiner*—Marina Fishman
(74) *Attorney, Agent, or Firm*—Muncy, Geissler, Olds & Lowe, PLLC

(57) ABSTRACT

A switch pin for SMD manufacturing processes to be mounted onto a circuit board includes a connection end located in a switch housing and a coupling end extended from the connection end and exposed outside the switch housing. The coupling end has a horizontal portion and a bend portion bending from the horizontal end towards the switch housing. Hence the signal pin and the circuit board can form a greater electric connection area to enhance electric effect. The bend portion also can prevent interference of other electronic elements installed on the circuit board.

5 Claims, 7 Drawing Sheets

SWITCH PIN FOR SMD MANUFACTURING PROCESSES

FIELD OF THE INVENTION

The present invention relates to a switch pin for SMD manufacturing processes and particularly to a signal pin which has a coupling end exposed outside a switch housing that includes a horizontal portion and a bend portion bending from the horizontal portion towards the switch housing to increase electric connection area of the signal pin and a circuit board to achieve a desired electric effect and prevent interfering with other electronic elements on the circuit board.

BACKGROUND OF THE INVENTION

With the advance of technology, the size of electronic devices (such as mouse) becomes smaller. The electronic elements used on those smaller electronic devices also have to be miniaturized. A great portion of these electronic elements are switches. Refer to FIG. 1 for a conventional switch. In order to meet the requirements of SMD (Surface Mount Device) manufacturing processes, the signal pins of the switch are exposed outside the switch. The exposed portion is straight and horizontal to the switch and a circuit board. Such a structure often creates fabrication problems or results in poorer quality. More details are elaborated as follow:

1. Due to shrinking of the electronic device, the interior space is limited. The space available to accommodate the circuit board also decreases. Hence the space occupied by the exposed signal pins is limited. As shown in FIG. 1, the extended and exposed portion of the signal pin takes too much space and affects installation of other electronic elements. This creates configuration design problem of the electronic elements.

2. To remedy the aforesaid shortcoming, some producers have shortened the length of the exposed portion or even keep the exposed portion on the bottom of the switch. While such an approach can reduce the occupied space, it also reduces the soldering paste attached thereon during the SMD processes and results in not secure bonding and not desirable electric effect of the switch. Moreover, when the electronic device is under functional test, if defects of the switch occur and replacement is needed, unsoldering for replacement is difficult because of the exposed portion is hidden on the bottom of the switch.

SUMMARY OF THE INVENTION

Therefore the primary object of the present invention is to solve the aforesaid disadvantages. The invention provides a signal pin which includes a connection end located inside a switch housing and a coupling end extended outside the switch housing from the connection end. The coupling end has a horizontal portion and a bend portion bending towards the switch housing from the horizontal end. Thus, electric connection area between the signal pin and a circuit board can increase to achieve the desired electric effect. Moreover, bending of the bend portion toward the switch housing can prevent interference on other electronic elements mounted onto the circuit board.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
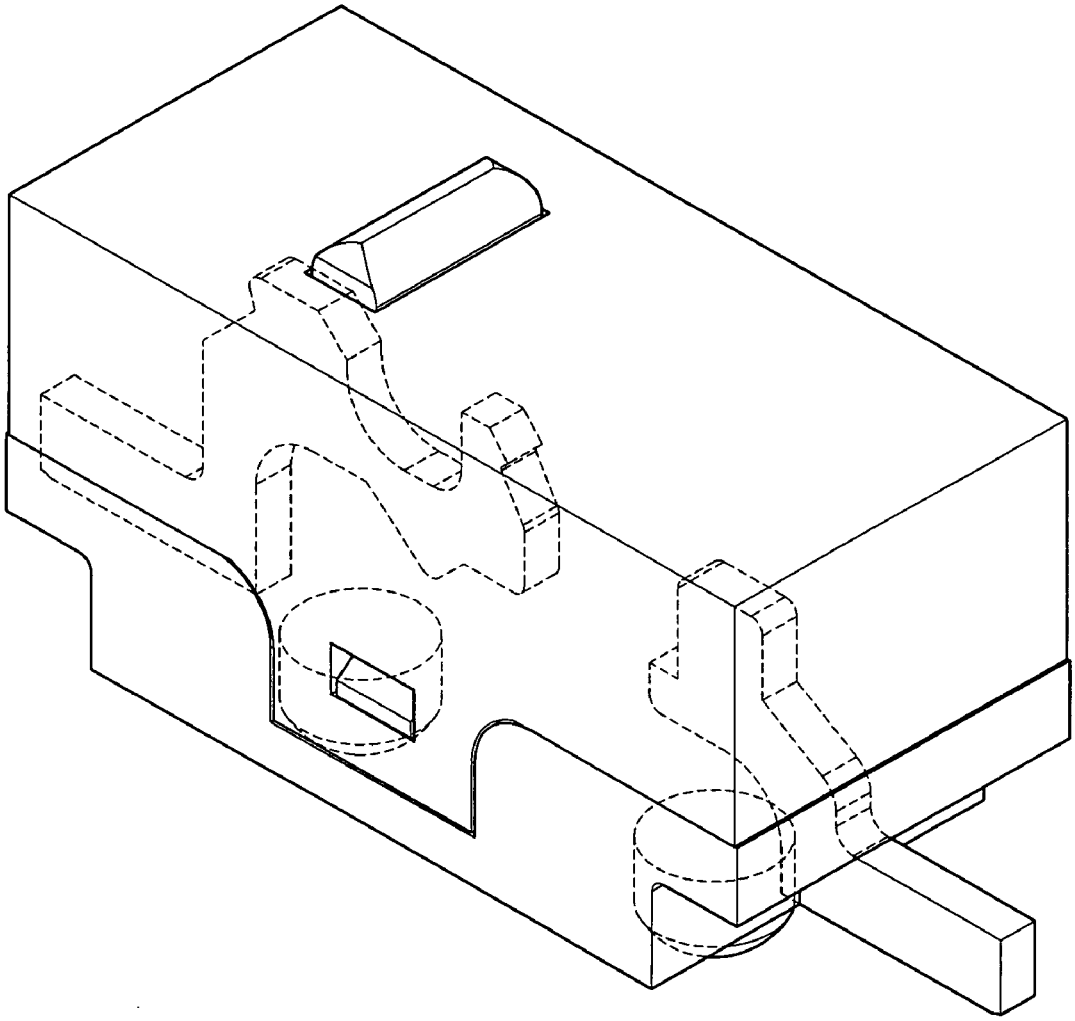
Fig. 1 PRIOR ART
FIG. 1 is a perspective view of a conventional switch.
Figure 2:
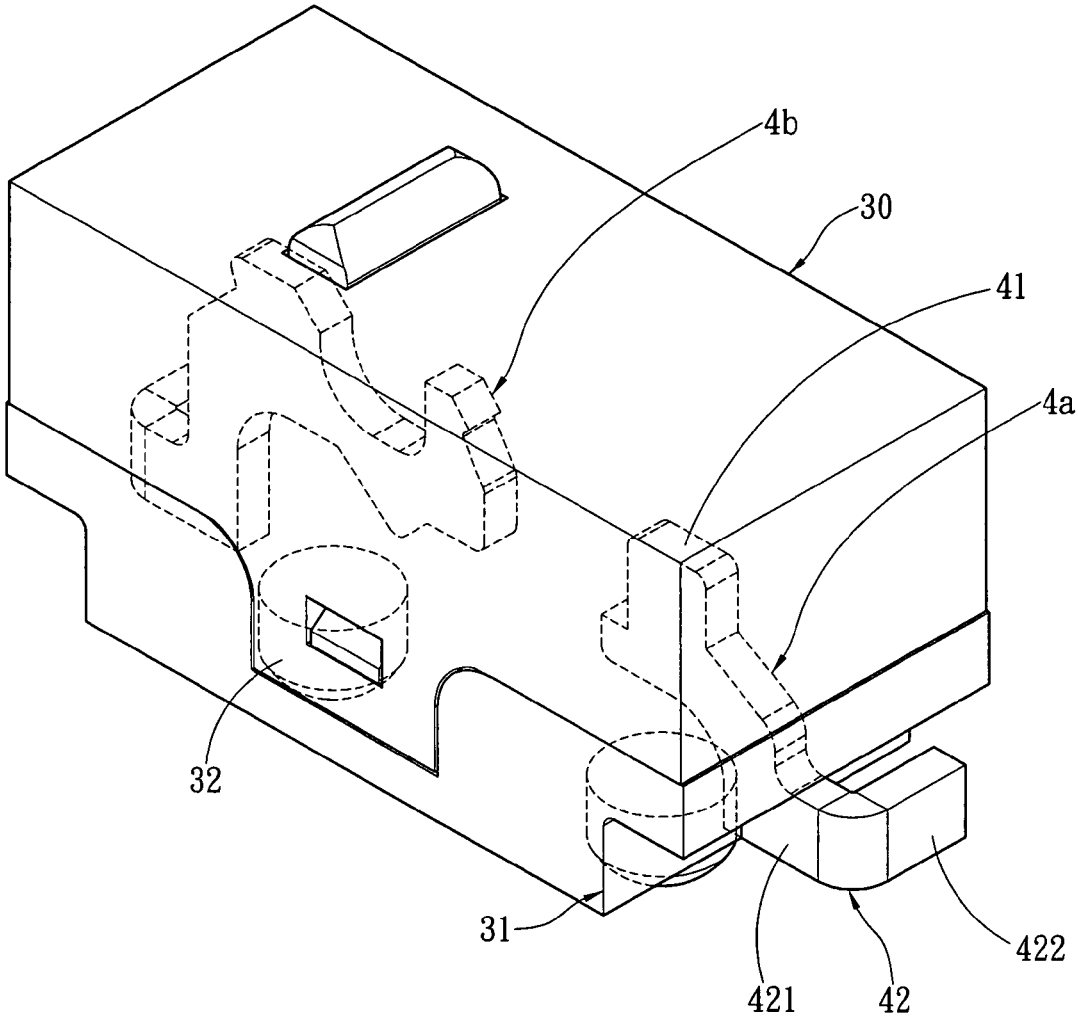
FIG. 2 is a perspective view of the present invention.
Figure 3:
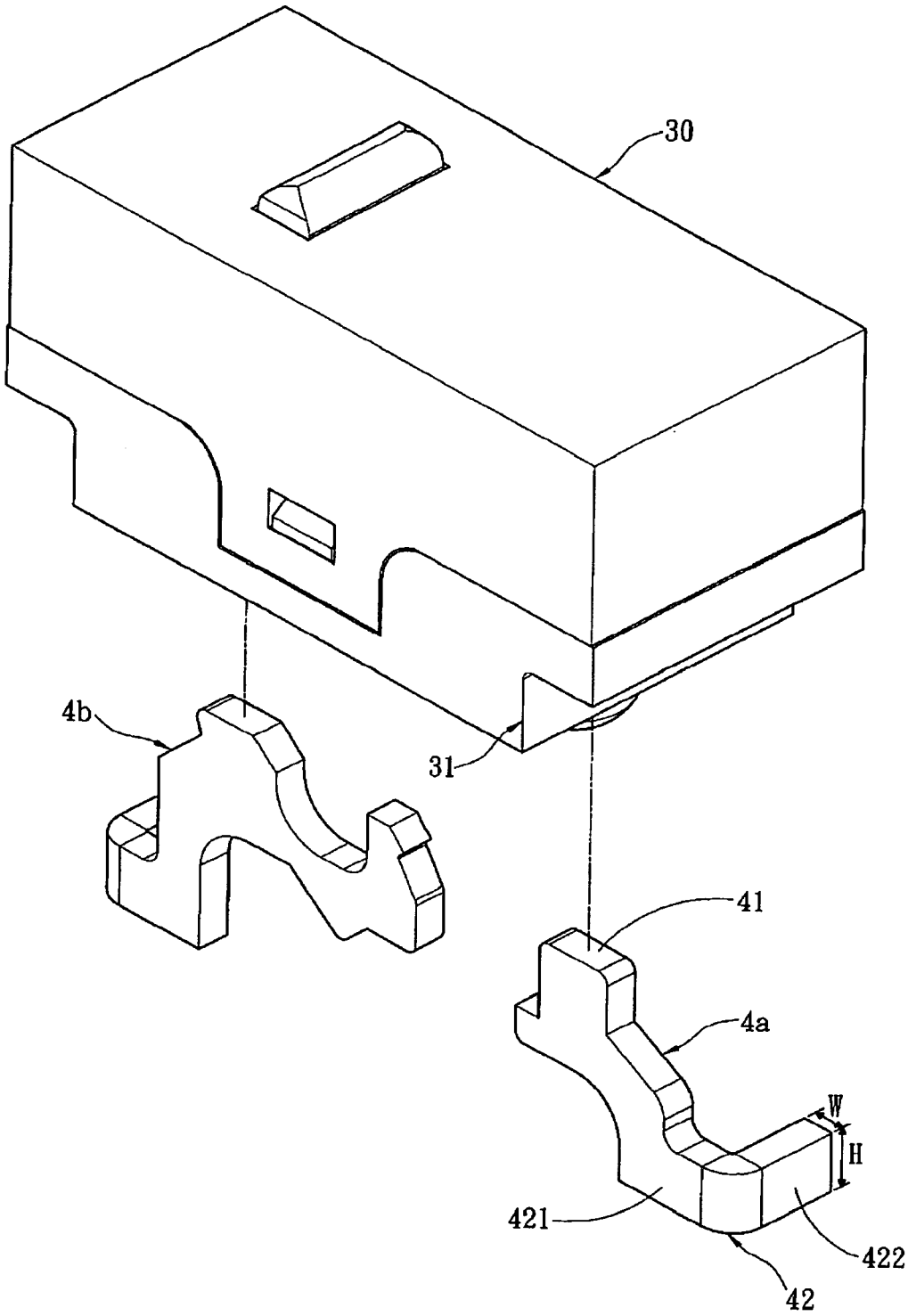
FIG. 3 is an exploded view of the signal pin of the present invention.

Please referring to FIGS. 2 and 3, the present invention aims to provide pins of a switch housing 30 to be used in SMD manufacturing processes. The switch housing 30 has signal pins 4*a* and 4*b* extended to be mounted onto a circuit board 10 through the SMD manufacturing processes. The techniques of generating signals by depressing the switch housing 30 and the SMD manufacturing processes are known in the art, and form no part of the present invention, thus the following discussion is confined to contents related only to the present invention.

Figure 4:
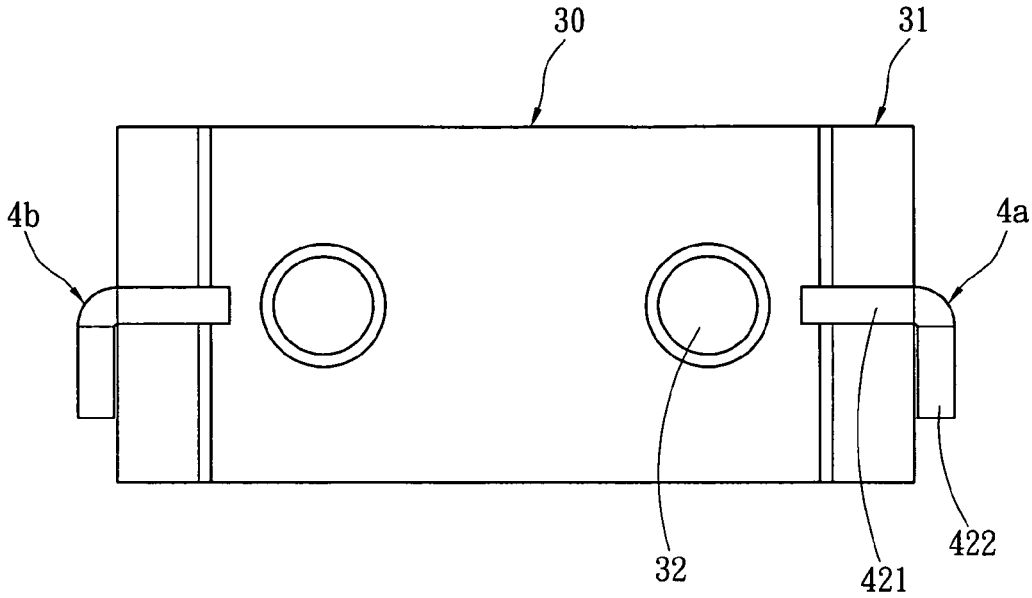
FIG. 4 is a bottom view of a signal pin configuration of the present invention.
Figure 5:
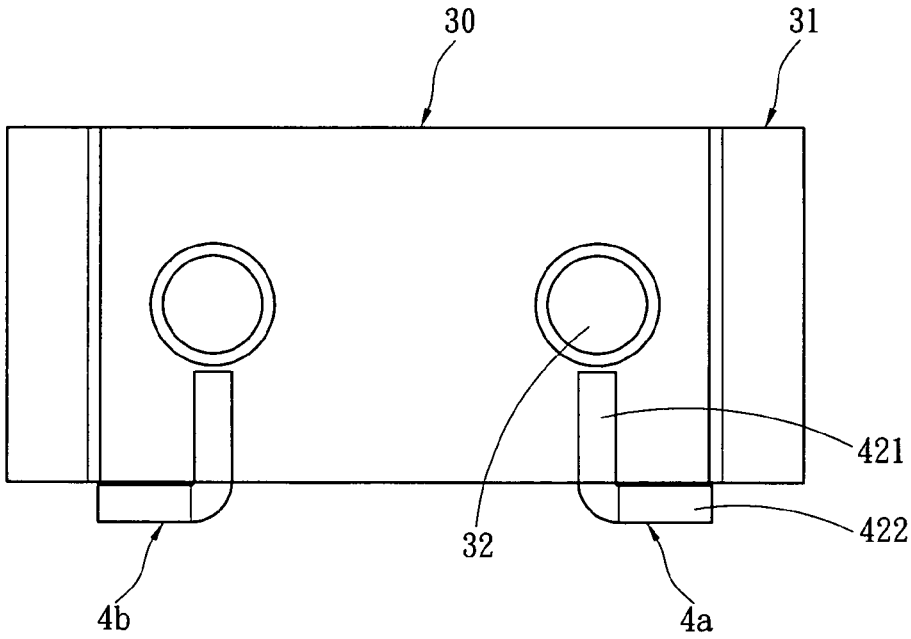
FIG. 5 is a bottom view of another signal pin configuration of the present invention.

The signal pins 4*a* and 4*b* have respectively a connection end 41 located inside the switch housing 30, the tip of the connection end being furthest from the bottom surface of the switch housing 30 and a coupling end 42 extended from the connection end 41 and exposed outside the switch housing 30. The coupling end 42 has a horizontal portion 421 and a bend portion 422 bending towards the switch housing 30. A height of the bend portion 422 being greater than a width W thereof. The horizontal portion 421 is located beneath the switch housing 30. The bend portion 422 is located on one side of the switch housing 30 (also referring to FIGS. 4 and 5). To facilitate unsoldering and replacement in the event of defects occurred to the switch housing 30 during test of the switch housing 30 on the installed electronic device, the switch housing 30 has an indentation 31 corresponding to the coupling end 42 of the signal pins 4*a* and 4*b*.

Figure 6A:
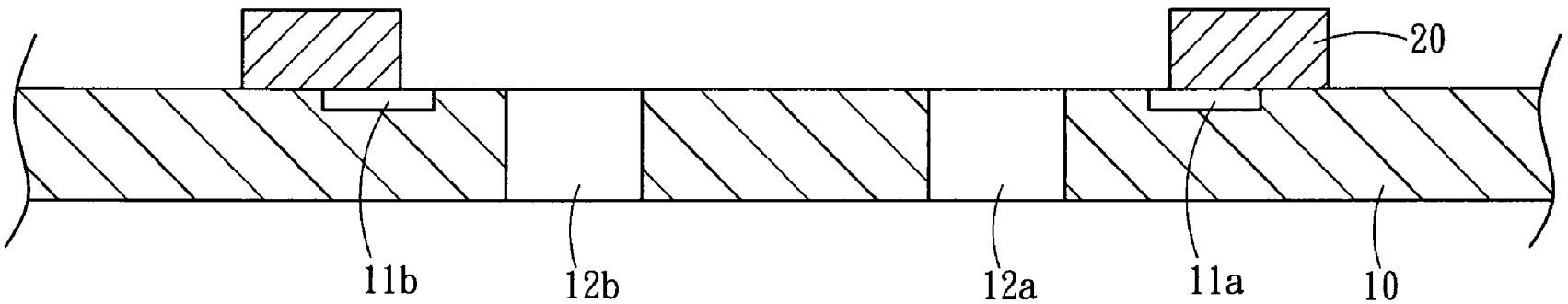
FIGS. 6A, 6B and 6C are schematic views of the invention used in SMD manufacturing processes.
Figure 6B:
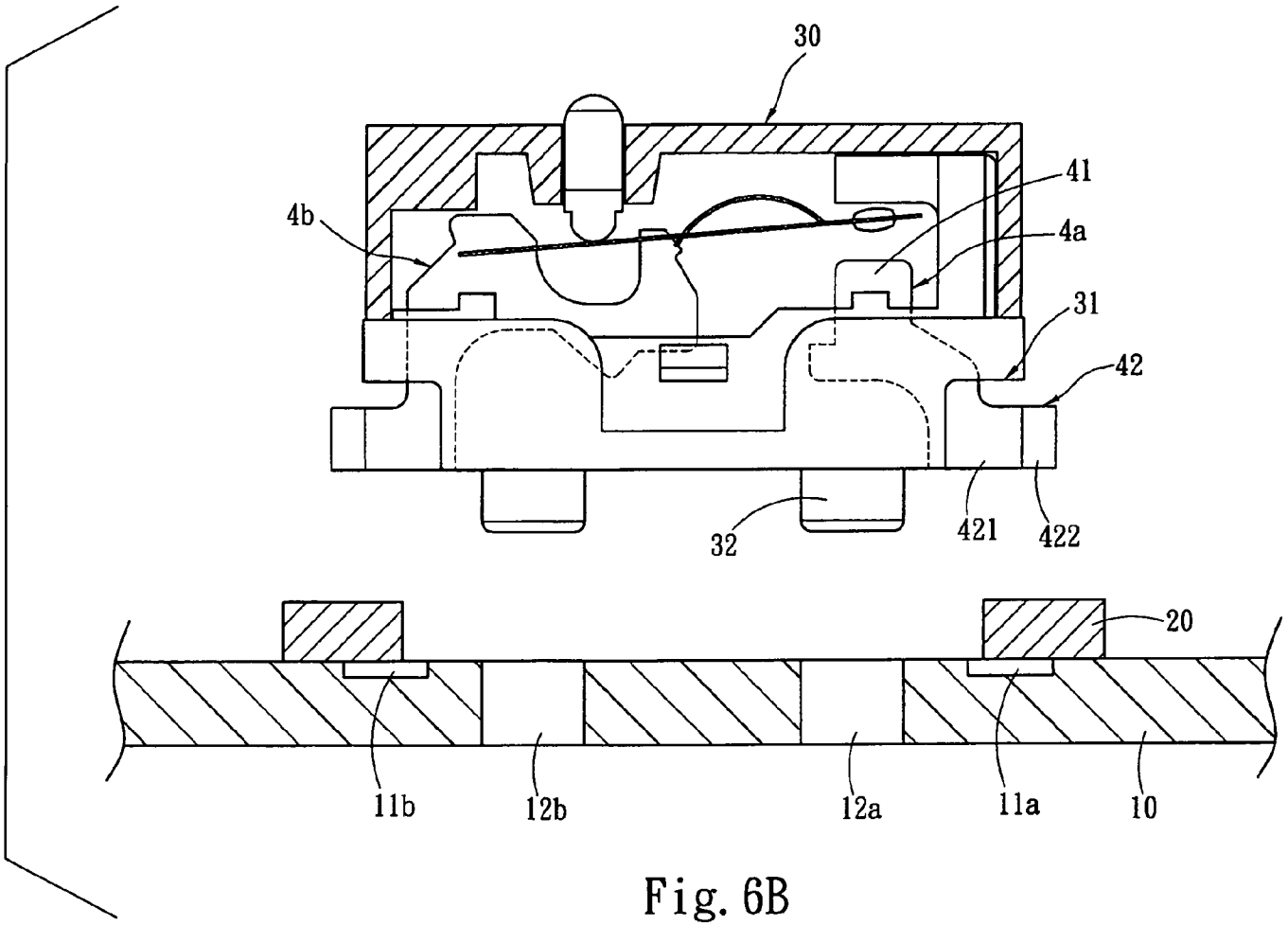
Figure 6C:
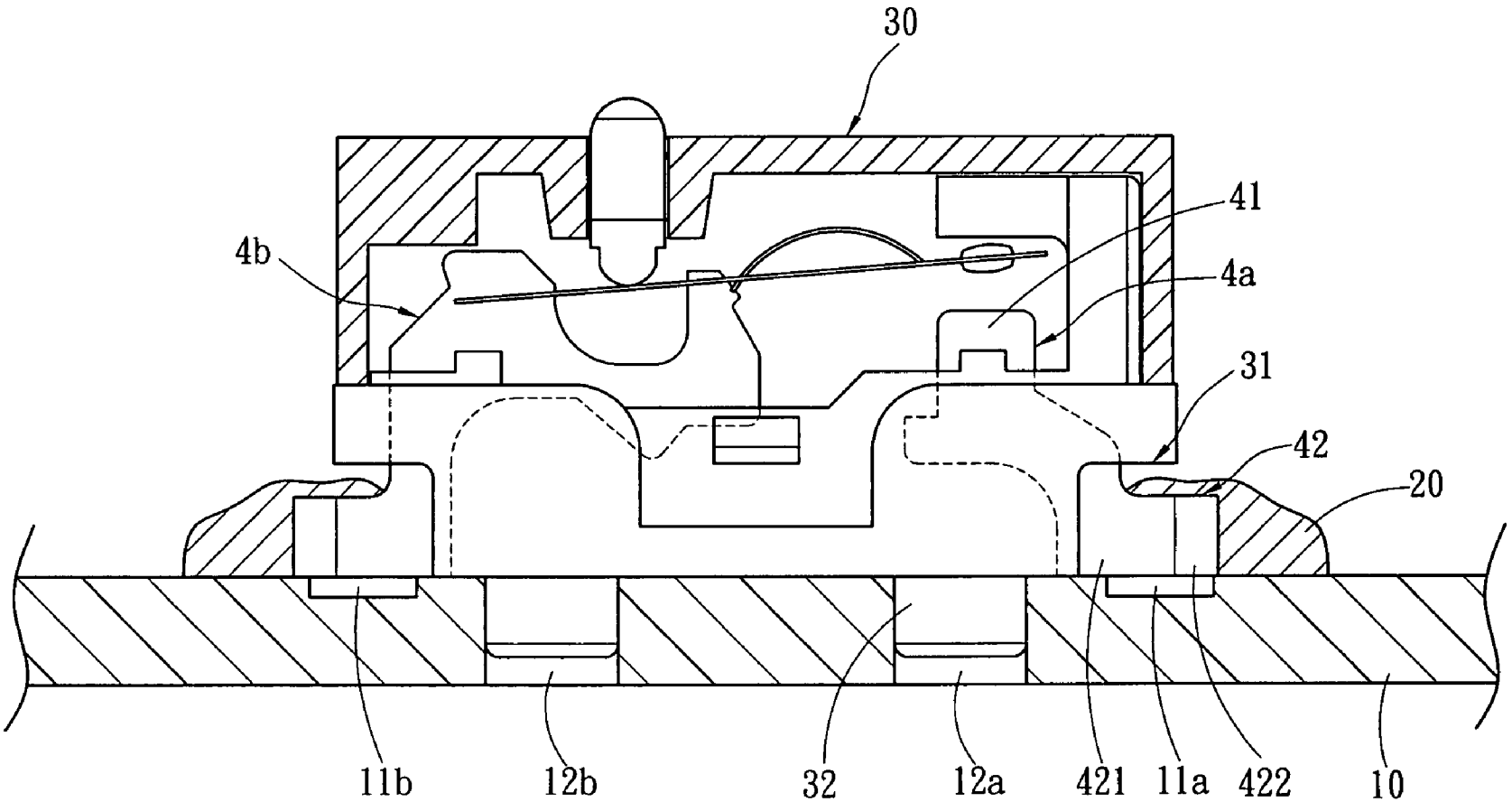

Refer to FIG. 6 for the invention adopted for use in the SMD manufacturing processes. First, prior to mounting the switch housing 30 onto the circuit board 10, dispense soldering pastes 20 (usually soldering tin) onto the circuit board 10 between the signal pins 4*a* and 4*b* and corresponding contacts 11*a* and 11*b* of the circuit board 10. Referring to FIG. 6B, mount the switch housing 30 onto the circuit board 10 with the signal pins 4*a* and 4*b* bonding to the soldering pastes 20. In this embodiment, to facilitate a secure soldering of the switch housing 30 during the SMD manufacturing processes, the switch housing 30 has bosses 32 on the bottom mating anchor holes 12*a* and 12*b* formed on the circuit board 10. Referring to FIG. 6C, while the switch housing 30 is fused at a high temperature on the circuit board 10 during the SMD manufacturing processes, the molten soldering pastes 20 bond the horizontal portion 421 and bend portion 422 of the signal pins 4*a* and 4*b*. A portion of the molten soldering pastes 20 even covers the upper side of the bend portion 422 (depending on the molten quantity of the soldering pastes 20). As shown in FIG. 6C, after the switch housing 30 is bonded to the circuit board 10, the soldering pastes 20, in addition to bonding the horizontal portion 421 and bend portion 422, also covers the bend portion 422. Thus a more secured bonding and enhanced electric effect can be achieved. Moreover, the bend portion 422 does not interfere installation of other electronic elements as the conventional switch does.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A switch pin for SMD manufacturing processes that has signal pins extended from a switch housing to be mounted onto a circuit board through the SMD processes, the switch housing having a bottom surface, the switch pin comprising:

a connection end with a tip located in the switch housing and a coupling end which is outside the switch housing and extended from the connection end, the tip of the connection end being furthest from the bottom surface of the switch housing and only one connection end being provided, the coupling end having a horizontal portion extending perpendicular to one side of the switch housing and a bend portion bending at an angle to said horizontal portion to be parallel to the side of the switch housing from the horizontal portion, an underside of the bend portion being in a same plane as an underside of the horizontal portion wherein the horizontal portion is located beneath the switch housing, the switch pin terminates at the bend portion which is located outside the side of the switch housing, the bent portion having a height which is greater than a width thereof.

2. A switch pin for SMD manufacturing processes that has signal pins extended from a switch housing to be mounted onto a circuit board through the SMD processes, the switch housing having a bottom surface, the switch pin comprising:

a connection end with a tip located in the switch housing and a coupling end which is outside the switch housing and extended from the connection end, the tip of the connection end being furthest from the bottom surface of the switch housing and only one connection end being provided, the coupling end having a horizontal portion extending perpendicular to one side of the switch housing and a bend portion bending at an angle to said horizontal portion to be parallel to the side of the switch housing from the horizontal portion, an underside of the bend portion being in a same plane as an underside of the horizontal portion, the switch pin terminates at the bend portion, the bent portion having a height which is greater than a width thereof.

3. The switch pin of claim 2, wherein the horizontal portion is between the connection end and the bend portion.

4. The switch pin of claim 3, wherein the horizontal portion is located beneath the switch housing and the bend portion is located outside the side of the switch housing.

5. The switch pin of claim 2, wherein the bend portion is located outside of the switch housing.

* * * * *